US005503337A

United States Patent [19]

Kreuziger

[11] Patent Number: 5,503,337

[45] Date of Patent: Apr. 2, 1996

[54] PROCESS FOR DISPERSING, BLENDING OR HOMOGENIZING MIXTURES, AND A DEVICE FOR EXECUTING THIS PROCESS

[76] Inventor: Wolf-Dieter Kreuziger, Theresiengasse 17, A-1180 Vienna, Austria

[21] Appl. No.: 512,560

[22] Filed: Aug. 8, 1995

Related U.S. Application Data

[63] Continuation of Ser. No. 104,113, Aug. 16, 1993, abandoned.

[30] Foreign Application Priority Data

Dec. 20, 1991 [AT] Austria ..... 2546/91

[51] Int. Cl.[6] ..... B02C 17/10; B02C 17/18; B02C 23/18

[52] U.S. Cl. ..... 241/21; 241/29; 241/152.2; 241/175; 241/180

[58] Field of Search ..... 241/21, 29, 152.2, 241/171, 175, 176, 177, 180

[56] References Cited

U.S. PATENT DOCUMENTS

| | | | |
|---|---|---|---|
| 882,646 | 3/1908 | Murray . | |
| 1,642,139 | 9/1927 | Brainard | 241/171 |
| 2,391,480 | 12/1945 | Ross et al. | 241/100 |
| 2,414,855 | 1/1947 | Cornell | 241/159 X |
| 2,417,599 | 3/1947 | Joyce, Jr. | 241/159 |
| 2,650,033 | 8/1953 | Ahlmann | 241/176 X |
| 3,504,621 | 4/1970 | Qualheim | 241/159 X |
| 3,683,733 | 8/1972 | Johan et al. . | |
| 3,750,966 | 8/1973 | Anderson . | |
| 3,929,295 | 12/1975 | Montalbano . | |
| 3,958,765 | 5/1976 | Musselman . | |
| 4,101,079 | 7/1978 | Fikhte et al. | 241/171 X |
| 4,269,364 | 5/1981 | Moriconi et al. . | |
| 4,776,522 | 10/1988 | Hoffman | 241/176 X |
| 4,809,915 | 3/1989 | Koffsky et al. . | |
| 4,971,261 | 11/1990 | Solomons . | |
| 5,025,994 | 6/1991 | Maitlen et al. | 241/100 X |
| 5,205,495 | 4/1993 | Garnier | 241/159 X |
| 5,248,102 | 9/1993 | Bohn | 241/100 X |
| 5,273,221 | 12/1993 | McCarthy | 241/100 X |
| 5,292,076 | 3/1994 | Pujol | 241/171 X |

FOREIGN PATENT DOCUMENTS

| | | | |
|---|---|---|---|
| 514335 | 10/1952 | Belgium . | |
| 1146306 | 5/1957 | France . | |
| 80411 | 4/1895 | Germany | 241/176 |
| 629074 | 2/1937 | Germany | 241/176 |
| 937627 | 1/1956 | Germany . | |
| 3327137 | 2/1984 | Germany . | |
| 1095995 | 6/1984 | U.S.S.R. | 241/177 |
| 1634 | of 1906 | United Kingdom | 241/100 |

OTHER PUBLICATIONS

Patent Abstracts of Japan, JP55–86526, Jun. 1980.

*Primary Examiner*—Timothy V. Eley
*Attorney, Agent, or Firm*—Cushman Darby & Cushman

[57] ABSTRACT

In a process for dispersing, blending or homogenizing of solid/liquid and/or liquid/liquid mixtures, the dispersion or emulsion to be homogenized is introduced into a rotating grinding chamber (5) which is at least partially filled with grinding bodies and is bounded by at least two rotatable wall elements (2, 4), wherein the dispersion or emulsion to be homogenized is guided through the grinding chamber (5) in a direction crosswise to the axis of rotation (3) of the wall elements (2, 4). In a device for executing the process having a grinding chamber (5) in which grinding bodies (19) are disposed, the grinding chamber (5) is bounded by at least two wall elements (2, 4) which are rotatably driveable, and the grinding chamber (5) has at least one feed and/or draw-off opening (15, 16,) on its sides facing towards and facing away from the axis of rotation (3).

20 Claims, 2 Drawing Sheets

PROCESS FOR DISPERSING, BLENDING OR HOMOGENIZING MIXTURES, AND A DEVICE FOR EXECUTING THIS PROCESS

TITLE OF THE INVENTION

This is a continuation of application No. 08/104,113, filed on Aug. 16, 1993, which was abandoned.

BACKGROUND OF THE INVENTION

The invention relates to a process for dispersing, blending or homogenizing of solid/liquid and/or liquid/liquid mixtures, and to a device for executing this process, having a grinding chamber in which grinding bodies are disposed.

In accordance with a previous proposal Austrian Letters Patent 395,544 a device for blending, homogenizing or reacting of at least two components was already known, wherein it was possible to omit separate mixing tools. Thus, in contrast to known stirring apparatus which dip into a container, the intent of this previous proposal had been to bring the material to be mixed into motion in respect to itself, so that at adjoining partial areas a strong relative movement of the material to be mixed is generated. The mixing zone formed in this way was intended to lead to blending as homogeneously as possible in the area of the mixing zone. To vary the mixing results, it was furthermore proposed to put the mixing zone under pressure by changing the volume of the rotating container, in which connection the use of such compression pressure was of importance, in particular in view of the possibility to achieve desired chemical reactions of individual components with each other. Continuous operation was possible in the previous proposal in that the blended material could be drawn off in the axial direction of the container, i.e. in the direction of the axis of rotation, wherein the partial section in which the most intense mixing took place was limited to the front faces, located opposite from each other, of oppositely directed, open, cylindrical containers.

OBJECTS OF THE INVENTION

Now, it is the object of the invention to improve an installation of the previously mentioned type in such a way that with small structural dimensions it is possible to increase the mixing zone substantially, and wherein furthermore the possibility is created to improve homogenization, even when using substances which are hard to mix with each other, in particular solid/liquid mixtures and liquid/liquid mixtures, for obtaining a dispersion or an emulsion. By means of the process of the invention it is simultaneously intended to create the possibility to counteract effectively the possible formation of clumps, which might occur in the course of producing such dispersions, and to split up assuredly agglomerations of the smallest size. Besides the assured blending, it is intended by means of the process of the invention to perform wet grinding and intense dispersion successfully even in cases where liquids of relatively high viscosity are used and where, because of the high viscosity, the separation of the grinding bodies from the liquid component is difficult with conventional processes. In accordance with the invention it is intended at the same time that an assured and easy separation of the grinding bodies is successful in spite of high viscosity, even if grinding bodies are used which have an extremely small diameter and where there are extremely slight differences in density in respect to the dispersion to be produced. Due to the employment of basic materials of higher viscosity it is also intended to process concentrates, wherein the throughput can be considerably reduced, for example when producing dilutable dyes on the basis of synthetic resin pigment.

SUMMARY OF THE INVENTION

To attain this object, the process of the invention essentially consists in introducing the dispersion or emulsion to be homogenized into a rotating grinding chamber which is at least partially filled with grinding bodies and is bounded by at least two rotatable wall elements, and in moving or guiding the dispersion or emulsion to be homogenized through the annular chamber in a direction crosswise to the axis (axes) of rotation of the wall elements. Due to the fact that the dispersion or emulsion to be homogenized is introduced into a rotating grinding chamber which is at least partially filled with grinding bodies and is bounded by at least two rotatable wall elements, a mixing zone is formed between the rotating wall elements, which with small dimension altogether assures a relatively large partial section of intense blending. At the same time intense wet grinding is assured because of the at least partial filling of the grinding chamber with grinding bodies, wherein an intense acceleration of the grinding bodies and blending takes place at the interface between the rotating areas of the grinding chamber. Because of the rotation of the rotatable wall elements and thus the rotation of the grinding chamber, a centrifugal force is simultaneously exercised on the grinding bodies which leads to the grinding bodies moving against each other under high pressure over a greater diameter of the grinding chamber and for this reason a high compression pressure and thus an improved wet grinding result is achieved in this partial area of the grinding chamber. But, simultaneously with this directed movement of the grinding bodies in the direction of the centrifugal force, the separation of the grinding bodies from the prepared emulsion or the prepared dispersion is now also improved, so that it is possible to draw off the finished material to be ground in a simple way over a reduced diameter, for example on the side of the grinding chamber located opposite this compression of the grinding bodies, without there being a need here for conventional separating techniques, such as the use of filters or screens, which tend to become clogged. Thus it is possible to improve the separation of the grinding bodies from the dispersion or the emulsion considerably by means of the process of the invention, the improvement being, amongst other things, that it is possible to eliminate the use of screens or filters when drawing off the mixture, for which purpose the process of the invention is executed in such a way that the dispersion or emulsion to be homogenized is moved or guided through the grinding chamber crosswise to the axis (axes) of rotation of the wall elements.

With wall elements which rotate in relation to each other, the partial area of intense blending between the rotating partial areas of the grinding chamber or mixing chamber is formed by an annular plane which essentially extends normally in respect to the axes of rotation. With an appropriate design of the rotating wall elements, however, the separation plane and thus the zone of the most intense blending can also be located in a plane corresponding to the surface area of a cone. Blending or swirling is a function of the relative speed existing between adjoining areas of the mixing chamber or grinding chamber. With opposite rotation of the wall surfaces this relative speed, and thus the dispersing effect becomes particularly high, where in connection with this a resulting centrifugal force in the grinding chamber for separating the grinding bodies should altogether be taken into consideration. Thus, the process can be advantageously executed in such a way that the mixing process is performed between wall elements which rotate in relation to each other with different rpm and/or direction of rotation.

The axes of rotation of the wall elements which are rotatable in relation to each other can be different from each other and essentially extend parallel to each other, by means of which it is possible to achieve a certain amount of eccentricity of the rotational movement in relation to the interface between the particles which rotate in relation to each other, and thus a particularly intense blending.

If the axes of rotation extend inclined toward each other, it is additionally possible to achieve a kneading effect to improve the blending over the entire radial extent of the grinding chamber. When employing wall elements with axes of rotation which are inclined toward each other, the wall elements can be driven at the same speed and in the same direction of rotation, the result of which is that a total movement of the mixture of material to be ground—grinding bodies is produced during each revolution, in spite of a small relative movement between the disks or wall elements and the material to be ground. This means that the energy supply can take place optimally and that the danger of local overheating, especially when processing materials of higher viscosity, does not exist. The possibility of being able to drive both wall elements at the same rpm and still to achieve an optimum grinding/mixing effect, also means a considerably simplification of the entire structure and in the end improves the centrifugal effects on all grinding bodies.

In this case the process is preferably executed in such a way that the material to be mixed or the mixture of grinding bodies/material to be ground is put into rotation at the same rotational speed as the two wall elements, and that the material to be mixed or the mixture of grinding bodies/material to be ground are moved at least once in the direction of the axis of rotation and once in the direction away from the axis of rotation during each revolution. The total result of this is that the relative movement in the direction of rotation between the grinding bodies/material to be ground and the driving disks or wall elements is practically zero and the exclusive mixing and grinding effects are achieved through the displacement of the mixture in the radial direction. It is achieved by means of this to set the pressure forces and separation effects exclusively as a function of the common rpm of these disks.

However, to simplify sealing and to simplify construction of a corresponding device it is easily possible to dispose the axes of rotation coaxially in respect to each other. There is the additional possibility to provide, outside of the grinding chamber bounded by the rotating wall elements, an additional possibility of pre-blending under high shearing stress. For this purpose the process of the invention is advantageously performed in such a way that the dispersion or emulsion to be homogenized is subjected, prior to its entry into the grinding chamber, to a shearing stress between rotating surfaces at the outside of the wall elements of the grinding chamber, wherein such a performance of the process by means of a structurally relatively simple device results in an additional intense blending.

Good separation of the grinding bodies from the dispersed or homogenized ground material without an expensive separation technique can be achieved in that the dispersion or emulsion to be homogenized is conveyed through the grinding chamber in a direction opposite to the direction of movement generated by the centrifugal force.

The material to be homogenized or dispersed can be advantageously fed in the radial direction from the outside to the inside, wherein the process can be performed continuously in a particularly simple manner in that the homogenized mixture is drawn off via an axial conduit. To set the appropriate pressure requirements and flow conditions, the outflow via the axial conduit can be appropriately throttled. As a whole, because of the possibility of being able to freely select the rpm and/or the direction of rotation of the wall elements which rotate in respect to each other, over a large range and the possibility of setting the respective flow speed and pressure conditions, an adaptability to different basic materials results, and homogenizing and blending even of difficult to mix, highly viscous substances, along with a simultaneous improvement of homogenization and of fine distribution or dispersion can be achieved. In the course of this the advantageous process is to fill the grinding chamber up to maximally 75% by volume, preferably 60% by volume with grinding bodies of an effective diameter of less than 0.5 mm, preferably less than 0.1 mm.

The device in accordance with the invention for executing this process, requiring little space and a small structural and installation outlay, and which in particular assures the adaptability to different basic materials, along with improved homogenization and blending at the same time, is advantageously embodied in such a way that the grinding chamber is bounded by at least two wall elements which can be rotatably driven, and that the grinding chamber has at least one feed and/or draw-off opening on its sides facing towards and away from the axis (axes) of rotation. In this case the feed opening can be connected to the front of the grinding chamber located radially on the outside, while the draw-off opening can terminate into an axial conduit in an area close to the axis. In a particularly simple manner, both of these openings can be formed by slits extending over the circumference of the grinding chamber, wherein the embodiment advantageously is made in such a way that the slits are located in a common separation plane of the grinding chamber which essentially extends normally in respect to the axis (axes) of rotation of the wall elements. With an embodiment of this type the result is a relatively large zone of intense blending with, at the same time, small dimensions in the area of the annular plane defined between the rotating partial areas. In place of the formation of a slit in the near-axial area for a draw-off opening by means of appropriate axial extensions of the wall elements, it is of course also possible to form the draw-off opening by means of an axial conduit formed in at least one wall element, wherein appropriate throttling means can be provided in this conduit. The grinding chamber has a generally circular exterior circumferential surface and, in the case of being embodied with slit-shaped openings in the near-axial area, is embodied as a toroid or annular chamber.

A further improvement of the ability to set the pressure conditions and the intensity of wet grinding can of course be achieved in the case were the grinding bodies in their movement in the direction of the centrifugal force are subjected to a particularly close proximity to each other with the simultaneous increase of the pressure forces which become effective when they near each other. This is made advantageously possible by a structural design in which the grinding chamber, bounded by the wall elements of the grinding chamber, is embodied, in a cross-sectional plane containing at least one axis of rotation, tapering crosswise in respect to this axis of rotation. In the course of the movement in accordance with centrifugal force of the grinding bodies in a cone tapering in this way, intensive blending is also assured outside of the surface where the primary blending takes place, because of which the effect of homogenization and the splitting of the smallest agglomerates is even more successful.

The embodiment is advantageously made in such a way that the wall elements are formed by half-shells, which are rotatably seated around a common axis and connected with separate drives, which results in a simple construction with simple seating. Premixing becomes advantageously possible on the outside of the mixing chamber or grinding chamber by means of the application of large shear forces in that the embodiment is provided in such a way that a wall element is connected, fixed against relative rotation, with a part which extends over the second wall element and forms a gap, and that the feed line terminates in this gap.

Intense blending, during which it might be possible to omit shear stress, can be achieved with an embodiment of the device in which the axes of rotation of the wall elements are disposed inclined in relation to each other and adjoin each other, enclosing an obtuse angle. If such a device is operated at the same rpm and the same direction of rotation of the wall elements, in particular disks, the relative movement of the wall elements is reduced to a cyclic squeezing, and generates a kneading effect, on which a shear stress at the boundary surfaces can also be superimposed, if differences in rpm or direction of rotation are permitted.

For further setting and adaptability of the conditions to different mixtures, the embodiment is preferably such that the angle between the axes of rotation of the wall elements can be continuously changed.

BRIEF DESCRIPTION OF THE DRAWINGS

The invention will be described below by means of an exemplary embodiment schematically shown in the drawings. Shown therein are.

DETAILED DESCRIPTION OF THE INVENTION

Figure 1:
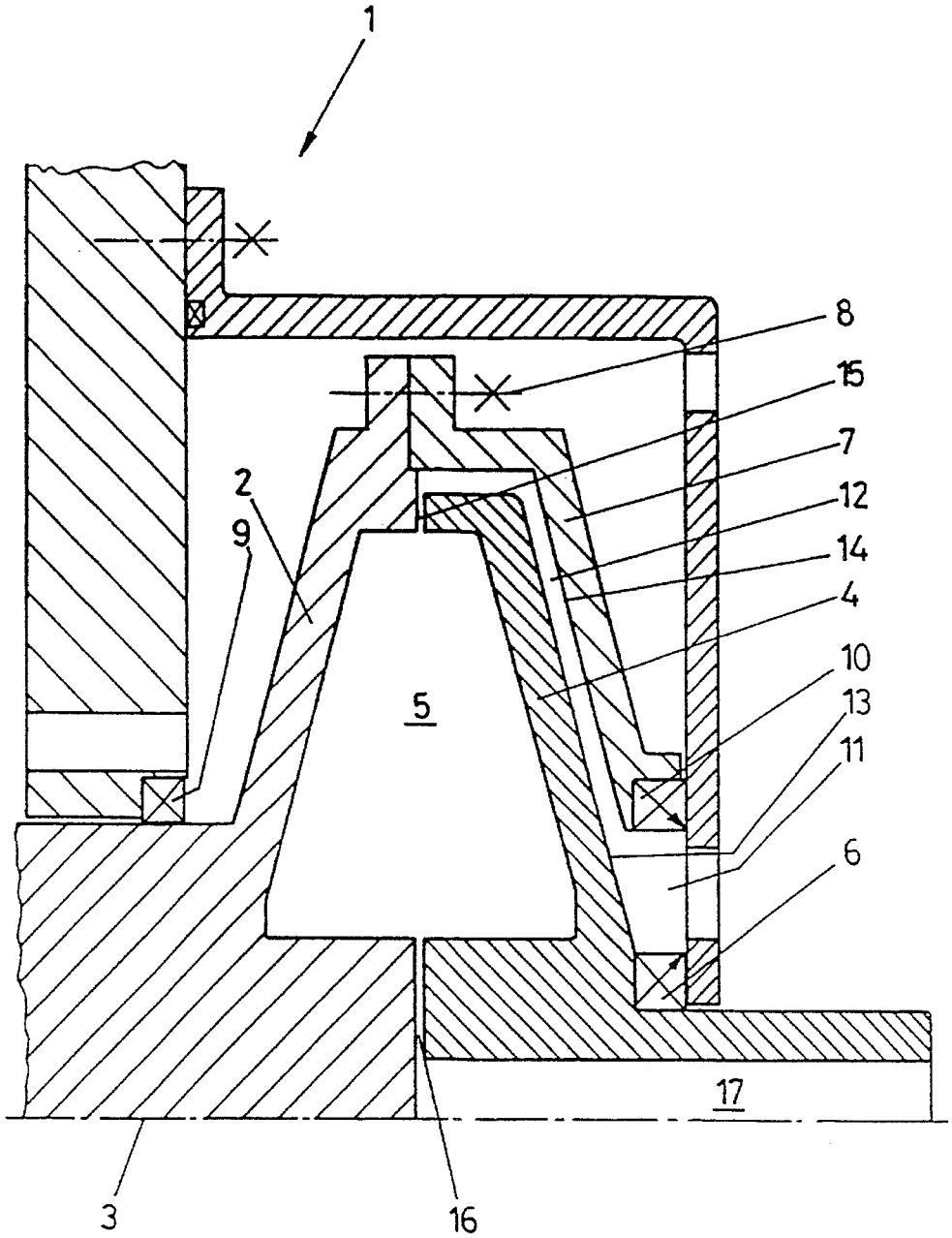
in FIG. 1 a partial section through a first embodiment of a device in accordance with the invention for executing the process of the invention; and in FIG. 2 a variant embodiment of the device of the invention with wall elements having axes of rotation inclined towards each other.
Figure 1:
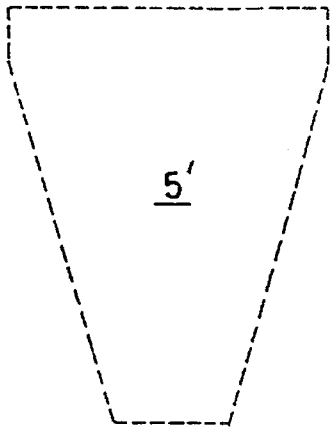

Only one half of the rotationally symmetrical embodiment of the device is shown in section in FIG. 1, the entire device ensuing from the reflection along the common axis of the two wall elements which delimit the grinding chamber.

The device for dispersing, blending or homogenizing of solid/liquid and/or liquid/liquid mixtures consists of a housing, generally identified by 1, in which a first wall element 2 in the shape of a half-shell is seated, rotatable around an axis of rotation 3 by means of a drive, not shown in detail. The shell-shaped wall element 2, together with a second, also rotatably seated shell-shaped wall element 4, delimits a grinding chamber 5 embodied as an annular chamber, wherein the grinding chamber in the second half of the drawings is indicated by dashed lines and 5' for making clear the symmetrical design. In the embodiment shown, the second wall element 4 is also rotated around the axis 3 by means of a drive, not shown in detail. A bearing for the wall element 4 in the housing 1 has been indicated by 6. A part 7, which extends over the outer surface of the second wall element 4, is connected, fixed against relative rotation, with the first rotating wall element 2, as indicated by 8, wherein the bearings for the first wall element 2 and the part 7 connected therewith are indicated by 9 and 10.

In this case the two shell-shaped wall elements 2 and 4 which delimit the grinding chamber 5 rotate around the common axis 3 at different rpm and/or different directions of rotation. The material to be blended, or the solid/liquid and/or liquid/liquid mixtures, enters the gap 12 between the outside wall 13 of the second wall element 4 and the inside wall 14 of the part 7 connected with the first wall element 2 via a feed line or a connector 11, wherein a strong shear stress of the introduced material is caused in this gap 12 by means of the elements 4 and 7, which rotate at different speeds and/or different direction of rotation. Then the material reaches the grinding chamber or annular chamber 5 via a slit or a feed opening 15, in which up to 75% by volume of grinding bodies, not shown, having an effective diameter of less than 0.5 mm, are disposed to assist dispersion, blending or homogenizing of the fed-in materials. In the grinding chamber 5, the fed-in materials are also subjected to a shear and mixing stress in that the two wall elements 2 and 4 which delimit or define the grinding chamber are driven at different rpm and/or in a different direction of rotation, which results in a mixing plane which is essentially formed by a circular plane. The appropriately blended or homogenized material is drawn off via a gap 16 facing the axis of rotation 3 and located between the rotating wall elements, and is removed via an axial conduit 17. In this case, the gaps 15 and 16 which define the feed and draw-off openings for the material to be mixed or homogenized, are located in a common plane extending normally in respect to the axis of rotation 3.

The grinding chamber 5 has a cross section which conically tapers from an area of the draw-off opening 16 near the axis toward an area of the feed opening 15 remote from the axis, so that there is a high concentration of grinding bodies in the area of entry into grinding chamber 5, which is aided by the direction of movement of the grinding bodies in the grinding chamber or annular chamber 5, caused by centrifugal force. At the same time it is possible, based on the illustrated arrangement of the feed and draw-off openings, to omit filters or screens or the like in the area of the draw-off opening 16 for separating the grinding bodies, because the grinding bodies are effectively moved in a direction away from the axis of rotation 3 by centrifugal force, so that, even in the case where the penetrating cross section of the gap or the draw-off opening 16 is greater than the particle size of the grinding bodies, and even with high viscosity of the materials to be mixed, the escape of the grinding bodies is assuredly prevented because of the high rotating speeds and the strains. Throttling devices, not shown in detail, are provided in the axial conduit 17 for regulation or control of the through-flow to achieve a desired result.

In case that two wall elements 2 and 4 have axes of rotation which are different from each other but are parallel to each other, the particular result is an eccentric movement of the one wall element in relation to the other, so that a corresponding narrowing and widening of the gap 12 between the outer surface of the wall element 4 and the inner surface of the rotating part 7 can be achieved.

In the case where the mixtures to be homogenized or dispersed have a greater specific weight than the grinding bodies, it is possible to reverse the functions of the feed and draw-off openings 15 or 16 by means of an appropriate selection of the parameters during blending or homogenizing.

Figure 2:
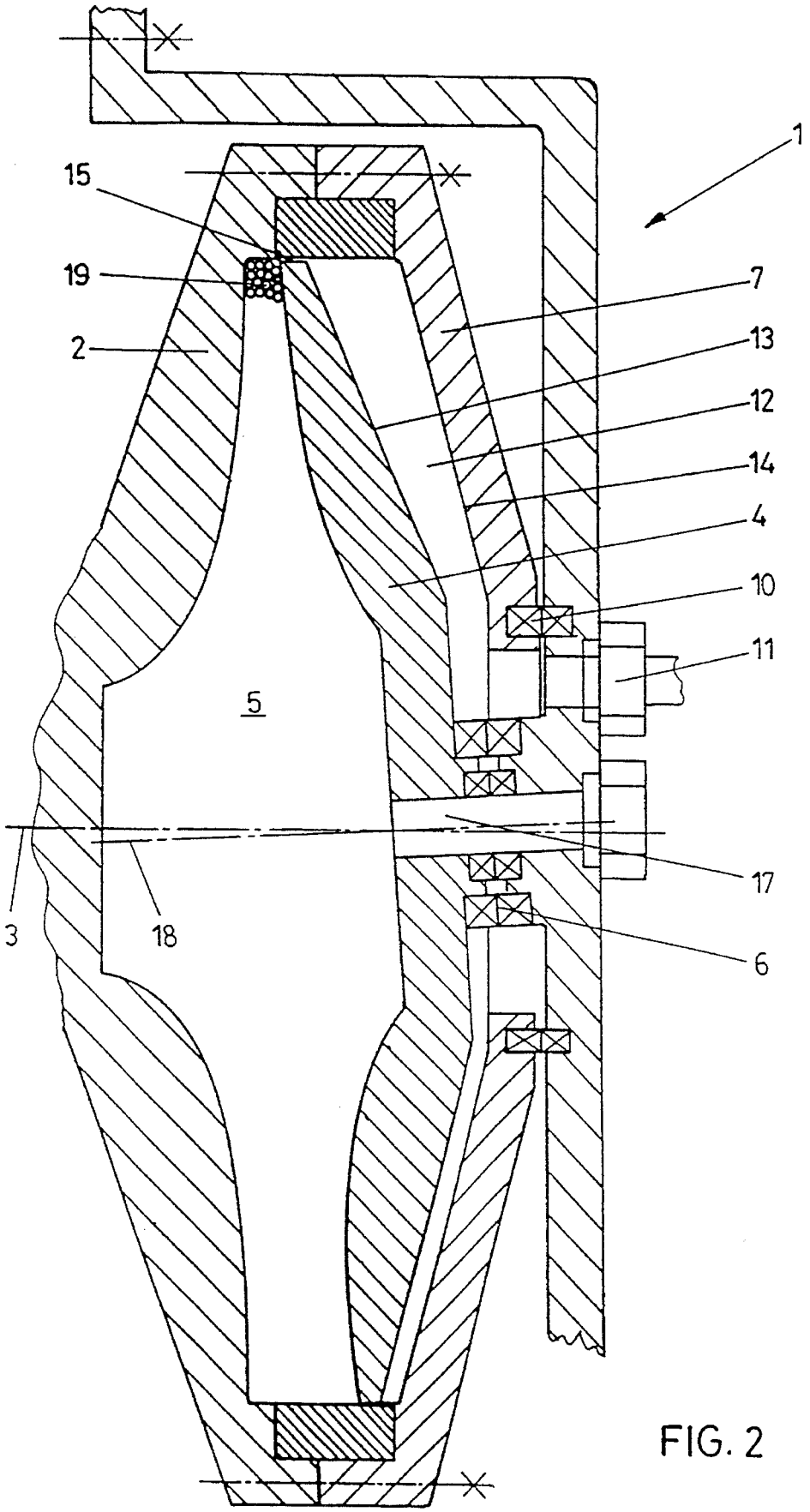

In the embodiment of FIG. 2, again a shell-shaped wall element 2 is driven around an axis of rotation 3 by means of a drive, not shown in detail, to produce a rotating movement.

Again, a part 7, extending over the second wall element 4, is connected secure against relative rotation with the wall element 2, in which case only the bearings 10 are sketched in. Differing from the embodiment in accordance with FIG. 1, the second shell-shaped wall element has an axis of rotation 18, which differs from the axis of rotation 3 of the first wall element 2, and encloses an obtuse angle with the axis of rotation 3. Because of the inclined disposition of the second wall element 4 in relation to the first wall element 2, a grinding chamber 5 is created, the cross section of which, again starting at the central area, tapers in the direction toward the areas remote from the axis, which results in different cross-sectional surfaces in different sections because of the inclination of the wall element 4 in respect to the wall element 2. Because of this, if the shell-shaped wall elements 2 and 4 are moved in the same direction and at the same rpm, it is possible to move the entire material to be homogenized, including the schematically indicated grinding balls 19, simultaneously without a noticeable relative movement between the grinding bodies 19 and the disks 2 or 4 occurring. Blending and homogenizing in this device is accomplished by an appropriate kneading effect, which is caused by the different cross-sectional surfaces particularly in the radially outwardly located areas of the grinding chamber 5 because of the inclined position of the wall element 4 in respect to the wall element 2. A kneading effect similar to the one in the grinding chamber 5 is caused in the gap 12 between the outer surface 13 of the wall element 4 and the inner surface of the part 7 extending over the wall element 4 and connected fixed against relative rotation with the first wall element. Thus, appropriate pre-processing also results with this embodiment before the material enters the grinding chamber 5 via a slit or gap 15, similar to the first embodiment of FIG. 1, in the course of which in the embodiment of FIG. 2 the blended material is drawn off directly via the axial conduit 17. Again the small grinding bodies are moved by centrifugal force into areas of the grinding chamber 5 remote from the axes of rotation 3 or 18, wherein, because of the cross-sectional surface which tapers to different degrees, a particularly strong stress by means of the grinding bodies 19 again takes place immediately prior to the entry of the material to be blended or homogenized into the grinding chamber 5.

The result of this embodiment, which employs a kneading effect, is that the mixing and grinding effect is practically exclusively caused by the forward movement of the mixture in the radial direction. The result as a whole is that there is no relative movement between the wall elements 2 or 4 and the material to be mixed, and that the mixture is moved at least once during each revolution of the wall elements in the direction toward the axes of rotation 3 and 18 and away from them.

The angle between the axes of rotation 3 and 18 can be continuously adjustable, starting with a position where they are aligned with each other, up to a maximum value, for adaptability to different materials to be mixed or homogenized.

I claim:

1. A process for mixing materials, at least one of which is liquid, comprising the steps of:

introducing said materials into a rotating grinding chamber which is at least partially filled with grinding bodies and which is bounded by at least two rotatable wall elements; and moving the materials through the grinding chamber in a direction crosswise of an axis of rotation of the respective wall elements.

2. A process according to claim 1, wherein said wall elements are rotated at the same speed about respective axes which are offset relative to one another whereby the grinding bodies and the materials within the grinding chamber are moved relative to one another towards and away from said axes during each revolution of the wall elements.

3. A process according to claim 1 or 2, wherein prior to entry into the grinding chamber, the materials are subjected to shearing stress at the outside of one of the wall elements.

4. A process according to claim 1 or 2 further comprising the step of drawing off the materials, after mixing in the grinding chamber, via a conduit which is substantially axial relative to an axis of rotation of a wall element.

5. A process in accordance with claim 1 or 2, wherein said materials are mixed while the grinding chamber contains at least 60% by volume of grinding bodies having an effective diameter of less than 0.5 mm.

6. A process according to claim 1, wherein said wall elements are rotated at different speeds.

7. A process according to claim 6, wherein prior to entry into the grinding chamber, the materials are subjected to shearing stress at the outside of one of the wall elements.

8. A process according to claim 6 or 7, wherein said materials are mixed while the grinding chamber contains at least 60% by volume of grinding bodies having an effective diameter of less than 0.5 mm.

9. A process according to claim 8, further comprising the step of drawing off the materials, after mixing in the grinding chamber, via a conduit which is substantially axial relative to an axis of rotation of a wall element.

10. A process according to claim 1, wherein said wall elements are rotated in different directions relative to one another.

11. A process according to claim 10, wherein prior to entry into the grinding chamber, the materials are subjected to shearing stress at the outside of one of the wall elements.

12. A process according to claim 10 or 11, wherein said materials are mixed while the grinding chamber contains at least 60% by volume of grinding bodies having an effective diameter of less than 0.5 mm.

13. A process according to claim 12, further comprising the step of drawing off the materials, after mixing in the grinding chamber, via a conduit which is substantially axial relative to an axis of rotation of a wall element.

14. A device for mixing materials, at least one of which is liquid, comprising:

a grinding chamber bound by at least two wall elements each rotatable about a respective axis, said chamber being at least partially filled with grinding bodies; and openings in said chamber for feeding materials to and from the chamber, at least one of said openings facing the axis of rotation of a wall element.

15. A device for mixing materials, at least one of which is liquid, comprising:

a grinding chamber bound by at least two wall elements each rotatable about a respective axis, said chamber being at least partially filled with grinding bodies; and openings in said chamber for feeding materials to and from the chamber, said openings being formed by slits extending over the circumference of the grinding chamber, at least one of said openings facing the axis of rotation of a wall element.

16. A device according to claim 15, wherein said slits lie in a plane extending substantially normal to the axis of rotation of a wall element.

17. A device according to claim 15 or 16, wherein said wall elements are oriented relative to one another such that the grinding chamber has tapered sidewalls.

18. A device according to claim 15 or 16, wherein said wall elements are connected to separate drives for rotating them about a common axis.

19. A device according to claim 15, wherein the wall elements are rotatable about separate axes which are angularly offset relative to one another.

20. A device in accordance with claim 15, 16, or 16 wherein one of said wall elements is fixed to a further element located in spaced relationship from an outer wall of the other of said wall elements thereby forming a gap therebetween through which said materials are fed to the grinding chamber.

* * * * *